United States Patent [19]

Johnson

[11] Patent Number: 4,893,487

[45] Date of Patent: Jan. 16, 1990

[54] LOCKING DEVICE FOR BOAT MOTOR

[76] Inventor: Todd W. Johnson, 3 Newtonville Ave., Newton, Mass. 02158

[21] Appl. No.: 366,674

[22] Filed: Jun. 14, 1989

[51] Int. Cl.[4] ..... E05B 73/00

[52] U.S. Cl. ..... 70/58; 70/211

[58] Field of Search ..... 70/58, 57, 18, 14, 212, 70/211, 210, 209, 207

[56] References Cited

U.S. PATENT DOCUMENTS

| | | | |
|---|---|---|---|
| 2,592,772 | 4/1952 | Wardius | 70/58 |
| 2,600,095 | 6/1952 | Consolo | 70/212 |
| 2,912,847 | 11/1959 | Putman | 70/58 |
| 2,984,096 | 5/1961 | Putman | 70/58 |
| 3,287,943 | 11/1966 | Vaughn | 70/58 |
| 3,650,130 | 3/1972 | Thompson | 70/58 |
| 3,933,015 | 1/1976 | Balicki | 70/49 |

*Primary Examiner*—Robert L. Wolfe

*Attorney, Agent, or Firm*—Wolf, Greenfield & Sacks

[57] ABSTRACT

A locking device for an outboard motor which both seals the turnbolts securing the motor to a boat transom to prevent removal of the motor and which inhibits trimming of the motor from an inoperative position to prevent the motor from being used to facilitate theft of the boat. For a preferred embodiment, a hollow tube of a hard, noncorrodible material such as hardened stainless steel is fitted over the turnbolt heads, a cylindrical lock is fitted in the open end of the tube to prevent removal thereof and a cable, preferable an armored cable is fixed to the tube near the closed end thereof and is adapted to fit around the motor to prevent trimming of the motor with the free end thereof passing through aligned openings in the tube and lock near the open end of the tube so that, when the lock is operated, it engages the cable to prevent removal of the lock from the tube and to secure the cable.

17 Claims, 2 Drawing Sheets

LOCKING DEVICE FOR BOAT MOTOR

FIELD OF THE INVENTION

This invention relates to locking devices and more particularly to a locking device which prevents an outboard motor from being removed from a boat by sealing the motor turnbolts and which prevents the motor prop from being lowered into the water, thereby inhibiting the stealing of the boat.

BACKGROUND OF THE INVENTION

Since an outboard motor is normally secured to the transom of a boat by a pair of manually operated turnbolts, it is relatively easy for a thief to quickly remove and steal such motors. The high cost of outboard motors has resulted in this becoming an increasing problem as boats are docked for varying periods of time when not in use.

There are a number of devices currently on the market which seek to alleviate this problem by providing a locking device which fits over the turnbolts and prevent the turnbolts from being operated. Examples of such devices are shown in U.S. Pat. Nos. 3,745,797; 3,808,851; 3,848,441 and 3,943,738. While all of these devices provide improved security for outboard motors, they have not completely eliminated the theft problem. One reason for this that all of these locking mechanisms utilize padlock type locking devices with at least a portion of the lock or hasp being exposed and being subject to attack by hacksaw, hammer, or similar tool. Padlocks also offer at best only limited security against being picked.

These devices have also generally been formed of a vinyl coated metal. As the vinyl wears away, rips or is otherwise removed, the metal tends to corrode, rendering the security device less effective.

Finally, and perhaps most important, while these devices inhibit the removal of the motor from the boat transom, they do not prevent the motor from being trimmed to an operative position. Thus, it is still possible to surreptitiously start the motor and to steal both the motor and the boat, the use of the motor facilitating a quick getaway by the thief.

A need therefore exists for an improved security device for outboard motors which both secures the turnbolts of the outboard motor and prevents the motor from being trimmed to an operative position with its prop in the water so that the motor may not be used to facilitate theft of the boat.

SUMMARY OF THE INVENTION

In accordance with the above, this invention provides an outboard motor locking device which consists of a hollow tubular member sealed at one end and normally open at the other end. A slot extending from the open end is formed in one side of the member, the length of the slot being greater than the spacing between the shanks of the turnbolts securing the motor to a boat transom. The hollow portion of the member is large enough to permit the turnbolt heads to be fitted therein when the slot is fitted, open end first, over the shanks. A locking means is provided for sealing the open end of the member when the member is positioned on the turnbolts, and an inhibit means is provided which is cooperatively associated with both the member and the lock means when these elements are in position securing the turnbolts, for engaging the motor to prevent it from being moved from an inoperative position with the prop out of the water to an operative position with the prop in the water. The inhibit means is preferably a flexible cable which is secured at one end at or near the sealed end of the tube, which is adapted to be passed around the motor when the motor is in its inoperative position to prevent movement of the motor to the operative position, and which, at its other or free end, may be passed through corresponding openings in the member and the locking means and engaged by the locking means to both prevent removal of the locking means from the member and to secure the free end of the cable. The cable is preferably a flexible armored cable and all elements of the locking device are preferably formed of a noncorrodible material such as stainless steel. For an alternative embodiment, the locking means is a cap which fits over the open end of the member, engages the cable to secure it in the member and has a lock with one or more feet which, in a locked position, engage matting slots in the wall of the member to secure the cap in place.

The foregoing and other objects, features and advantages of the invention will be apparent from the following more particular description of preferred embodiments of the invention as illustrated in the accompanying drawings.

IN THE DRAWINGS

DETAILED DESCRIPTION

Figure 1:
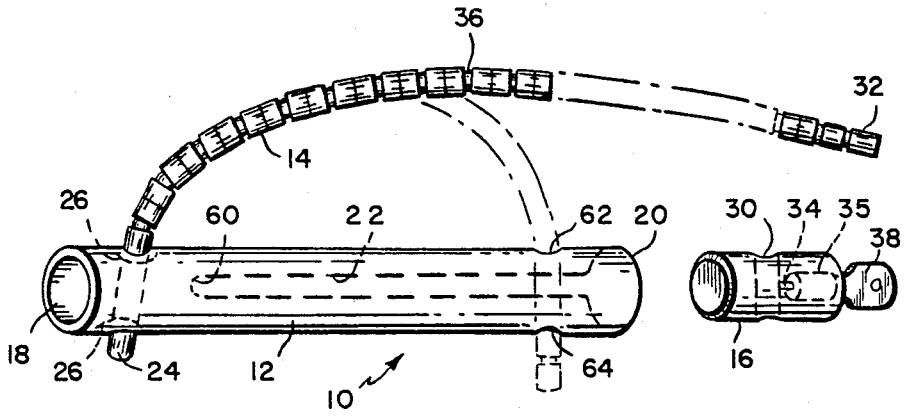
FIG. 1 is an exploded perspective view of the locking device of a first embodiment of this invention in its unlocked condition with the position of the cable in the locked position being shown in dotted lines.

As best seen in FIG. 1, the locking device 10 for a first embodiment of this invention is formed of three separate elements, a hollow tube 12, a length of flexible armored cable 14, and a pop-up type cylindrical lock 16. Tube 12 is sealed at one end by for example a permanent cap 18 which is welded or otherwise permanently secured therein, by originally fabricating the tube 12 with one end closed or by other suitable means. End 20 of tube 12 is normally open. A slot 22 extends along the length of tube 12 from the open end 20 thereof toward closed end cap 18. The length of tube 12 and of slot 22 as well as the inner diameter of tube 12 may vary to some extent with the size of motor which the locking device is adapted to be used with and with the sizes of the turnbolts, and in particular the heads of the turnbolts, being used. The outer diameter of tube 12 is determined primarily by the thickness which is desired for the tube. For a preferred embodiment, adapted for use with most standard outboard motors, the total length of tube 12 might be 34 cm with the length of slot 22 being 28 cm. The inner diameter for the tube would be approximately 4 cm with the thickness of the tube being approximately ½ to 1 cm. Tube 12 is preferably formed of a hard but nonbrittle, noncorrodible material. For the preferred embodiment, tube 12 is formed of hardened stainless steel or of a hardened steel with two stage anodized coating and ceramic cladding over the coating.

Figure 2:
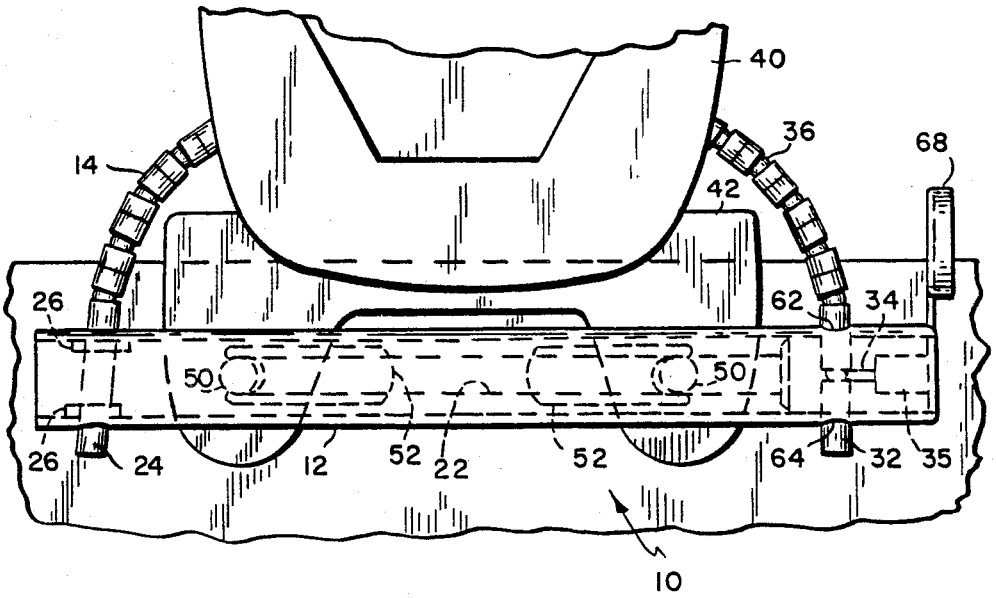
FIG. 2 is a front view showing the locking device of FIG. 1 in the locked position attached to a motor which is mounted on a boat transom and is in the raised, inoperative position.
Figure 3:
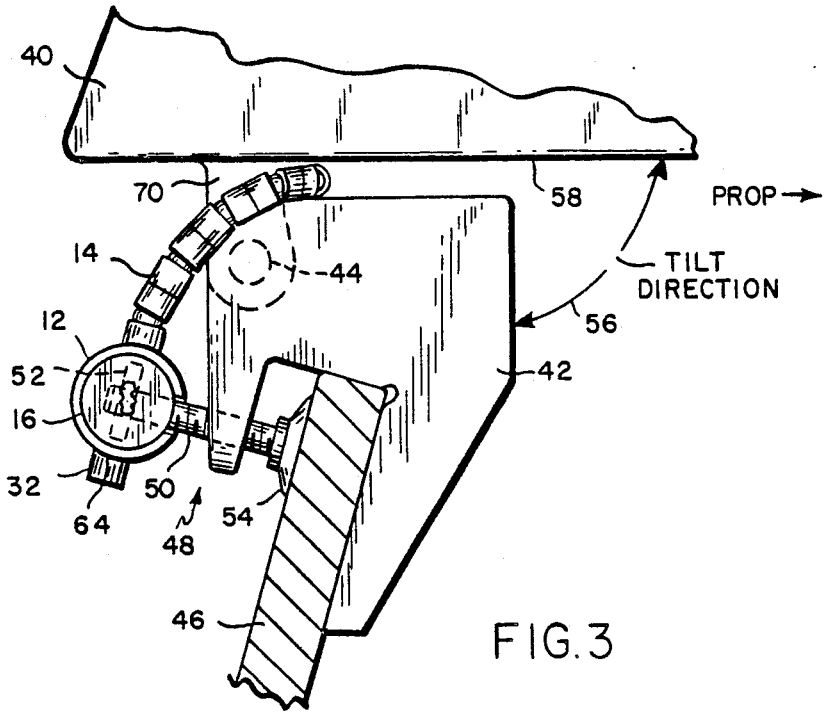
FIG. 3 is a side view of the locking device, a portion of the motor, and a cut away view of the boat transom with the motor mounted to the transom and the locking device securing the motor.

Cable 14 should be of sufficient length so as to be able to fit around the mounting bracket 42 for the motor as shown in FIGS. 2 and 3. A length of 142 cm for the cable 14 should be adequate for most applications. Cable 14 may be a standard flexible armored cable such as the armored, ball and socket type cable shown in U.S. Pat. No. 3,765,196. Such cables are available from J. J. Touk Company, 1800 Touhy Avenue, Oak Grove, Ill. Similar cables are shown in U.S. Pat. Nos. 3,696,647 and 3,933,015. With such cables, a length of braided cable is covered with alternate armored sections formed of spherical ball members and socket members, the armored sections being formed of hardened stainless steel or similar material.

Cable 14 has an end section 24 which is permanently secured in tube 12 near the sealed end 18 thereof. Section 24 passes through a pair of aligned openings 26 in tube 12 and is held in tube 12 by a suitable means such as a pair of clips or press pins 27 which fit into ridges (not shown) in end section 24 and expand after being forced through holes 26 to prevent removal of the end section.

Locking member 16 is a standard pop up type cylindrical lock of the type described in the cable patents previously indicated, such as for example U.S. Pat. No. 3,765,196. Locking member 16 has a cylindrical opening 30 formed therethrough which is sized to permit the free end section 32 of cable 14 to pass therethrough. When locking mechanism 35 of the locking member 16 is depressed, a tongue 34 is extended in a well known manner described in the patent indicated above, to engage a space 36 between two links in cable 14 in the manner shown in FIG. 2. A key 38 is provided which may be inserted in lock 16 in a known manner, operation of key 38 releasing the lock and permitting the locking 35, including tongue 34, to pop up. Lock 16 would also be formed of a hard, corrosion resistant material such as hardened stainless steel.

FIGS. 2 and 3 illustrate the manner in which the locking device 10 is utilized. Referring to these figures, an outboard motor 40 is attached to a mounting bracket 42 by a pivot pin 44 (FIG. 3). Mounting bracket 42 is attached to the transom 46 of a boat by a pair of turnbolts 48, each of which turnbolts has a shank portion 50, a head portion 52, and an end portion 54 which bears against transom 46. Motor 40 is normally pivotable about pin 44 in the direction shown by arrow 56 between an inoperative position as shown in FIG. 3 with the shaft 58 of the motor substantially perpendicular to transom 46 so that the prop (not shown) of the motor is out of the water and an operative position where shaft 48 is lowered between the arms of brackets 42 to a substantially vertical position with the motor prop in the water. When in the operative position, motor 40 may be utilized to drive the boat.

To lock the boat against theft, the motor is raised to the inoperative position shown in FIG. 3. Open end 20 of tube 12 is then fitted over the heads 52 of turnbolts 58 with tube 12 oriented such that slot 22 is adjacent the turnbolt shafts 50 and the shafts 50 pass through slot 22 as tube 12 is moved over the turnbolt heads. When the tube has been positioned to completely cover the turnbolt heads 52, or when the shank portion 50 for the turnbolt nearest the end 18 of tube 12 butts against end 60 of slot 22, the tube is fully mounted and lock 16 may be inserted in open end 20 of tube 12 until its hole 30 aligns with a corresponding pair of holes 62 and 64 formed in the top and bottom respectively of tube 12. At the same time the free end 32 of cable 14 is passed between bracket 42 and shaft 58 as shown in FIG. 3 and is then passed through aligned holes 62, 30 and 64 and pulled until there is no slack in the cable. The locking mechanism 35 of lock 16 is then pressed in and the position of cable 36 in opening 30 is adjusted slightly until tongue 34 fits into a groove 36 in the cable permitting the lock to engage.

At this point, the lock is fully inserted in tube 12, as shown in FIG. 2 and is not easily subject to tampering. A waterproof plug 68 of rubber or other suitable material may be provided to keep water out of tube 12 when the tube is mounted to turnbolts 48. As may be best seen in FIG. 3, with cable 14 secured as shown in this figure, the cable bears against the flange 70 which extends from the motor and is attached to pin 44. This prevents motor shaft 58 from being rotated in the clockwise direction (when looking in the direction of FIG. 3) to move the shaft to the operative vertical position between the arms of bracket 42. Thus, cable 14 is operative to prevent the motor from being trimmed into the water and thus used to facilitate theft of the boat.

Figure 4:
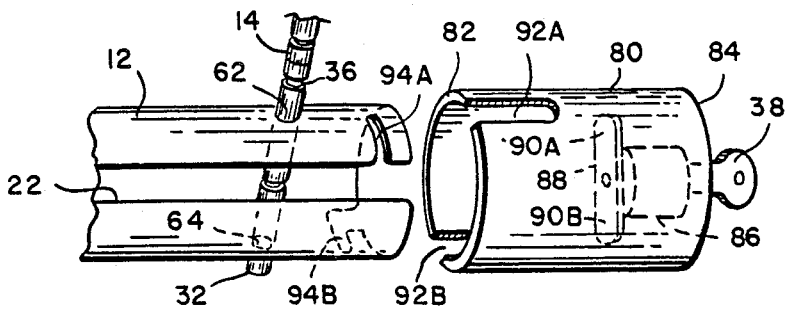
FIG. 4 is an exploded perspective view of a portion of a locking device for an alternative embodiment of the invention.

FIG. 4 illustrates an alternative embodiment of the invention whereon the locking member 16 is replaced by a locking cap 80. The cap 80 has an open forward end 82 and a closed rear end 84. A suitable lock, such as a standard role tumbler lock 86, is permanently secured to the closed rear end 84 of cap 80 and extends therefrom into the cap. A radial blade 88 having extending feet 90A and 90B is mounted to the end of locking mechanism 86 in a manner to be rotated by the lock when the lock is moved by a key 38 between a locked and unlocked position. A pair of grooves or notches 92A and 92B are formed in the forward end 82 of the cap. Radial slots 94A and 94B extend from slot 22 and a slot 96 respectively, the slot 96 being roughly 180° spaced along the periphery of tube 12 from slot 22.

In operation, with the locking mechanism 86 unlocked, cap 82 is inserted over tube 12 with groove 92 fitting in corresponding space 36 of cable 14. When the ends of the grooves 92 but cable 14, feet 92A and 92B should have passed into slots 22 and 96 respectively and be adjacent to corresponding slots 94 Key 38 may then be operated to rotate feet 90 into the corresponding slots 94 to secure the cap on tube 12. The grooves 92 fitted in corresponding spaces 36 secure cable 14 in holes 62 and 64 to complete the locking operation. Except as indicated above, the mechanism of FIG. 4 operates in the same manner a that previously described for the locking device of FIGS. 1–3.

While in FIG. 4 the feet 90 have been shown as being at the end of a rotary blade 99, it is apparent that the feet can be moved into slots 94 by other known suitable means. For example, separate foot members 90 may be provided which are normally biased to a retracted position, but are expanded to fill the slots 94 when key 38 is operated by rotation of an eccentric cam position therebetween or by other suitable means.

While for the embodiments of the invention as shown in the figures a standard ball and-socket armor plated cable has been utilized with tongue 34 being fitting between two armor sections, it is possible to form the cable in other configurations. For example, the cable may be formed from identical nesting or interlocking sections each of which has a lock notch formed therein which coacts with tongue 34 to prevent removal of the cable from hole 30 in lock 16. The advantage of this configuration is that it further reduces the possibility of the cable inside the armor becoming exposed and subject to cutting.

An improved outboard motor locking mechanism is thus provided wherein the lock is completely enclosed so as to be more resistant to cutting or tampering, and which is designed to both prevent removal of the outboard motor from the transom of the boat and to prevent use of the motor to facilitate theft of the boat by preventing the motor from being lowered into an operative position with the prop of the motor in the water.

While the invention has been particularly shown and described above with reference to preferred embodiments, the foregoing and other changes in form and detail may be made therein by one skilled in the art without departing from the spirit and scope of the invention.

What is claimed is:

1. A locking device for a motor mounted to a boat by at least one turnbolt, each turnbolt having a head and a shank, the motor having a prop and being moveable between an operative position with said prop in water and an inoperative position with the prop out of water, the locking device comprising:

a hollow tubular member which is sealed at one end and is normally open at the other end, a slot extended from the open end being formed in a side of said member, the length of said slot being greater than the spacing between the two most widely separated of said turnbolt shanks, the hollow portion of said member being large enough to permit the turnbolt heads to be fitted therein when said slot is fitted, open end first, over said shanks;

locking means for sealing the open end of said member when said member is positioned on said turnbolts; and inhibit means cooperatively associated with said member and said locking means when said member is mounted on said turnbolts and sealed by the locking means for engaging the motor to prevent the motor from being moved from its inoperative to its operative positions.

2. A locking device as claimed in claim 1 wherein said inhibit means interacts with said locking means to prevent said locking means from being removed from said tube.

3. A locking device as claimed in claim 1 wherein said inhibit means is a flexible cable which has a first end secured to said member at or near the sealed end thereof, which is adapted to be passed around said motor when the motor is in the inoperative position to prevent movement of the motor to the operative position, and which has a second end which may be passed through corresponding openings in said member and locking means, and is adapted to be engaged by said locking means, to both prevent removal of the locking means from the tube and to secure the second end of the cable.

4. A locking device as claimed in claim 3 wherein said cable is a flexible armored cable.

5. A locking device as claimed in claim 4 wherein said cable is an armored ball and-socket type cable.

6. A locking device as claimed in claim 1 wherein said member, said locking means and said inhibit means are formed of materials which are resistant to corrosion.

7. A locking device as claimed in claim 6 wherein at least one of said member, locking means and inhibit means are formed of stainless steel.

8. A locking device as claimed in claim 1 wherein said locking means is a pop up type cylinder lock.

9. A locking device as claimed in claim 1 wherein said inhibit means is a flexible cable which has a first end secured to said member at or near the sealed end thereof, which is adapted to be passed around said motor when the motor is in the inoperative position to prevent movement of the motor to the operative position, and which has a second end which may be passed through aligned openings near the open end of said member, said cable having engagement means at least near said second end; and wherein said locking means includes a cap having an open forward end adapted to fit over and seal the normally open end of said member and a closed rear end, a lock extending into said cap from said closed rear end, at least one foot extending radially from said lock and adapted to be moved thereby between a locked and an unlocked position, the forward end of said cap including means for interacting with said engagement means to prevent the second end of the cable from being removed from the aligned opening in the member when the cap is fully fitted over the member;

the member including means for cooperatively acting with said foot when the cap is fully fitted over the member and the foot is in a locked position to prevent removal of the cap from the member.

10. A locking device as claimed in claim 9 wherein said cable is a flexible armored cable.

11. A locking device as claimed in claim 10 wherein said cable has spaced notches formed in the armor; and wherein the means to prevent removal of the second end of the cable includes a pair of notches formed in the forward end of said cap, spaced by approximately 180°, and adapted to coact with a pair of spaced notches on said cable to secure the second end of the cable in said aligned openings.

12. A locking device as claimed in claim 9 wherein the member removal prevention means includes at least one radial slot formed in a wall of said member and adapted to receive said foot when the cap is fully over the member and the foot is in its locked positions.

13. A locking device as claimed in claim 9 wherein said lock is a roll tumbler lock which is operative to rotate said foot between the locked and unlocked positions; and wherein the member removal prevention means include a radial slot in the side of the member near the open end thereof and extending from the slot in the member, the foot entering the member through the slot when in the unlocked position and moving into the radial slot when in the locked positions to secure the cap to the member.

14. A locking device for a motor mounted to a boat by at least one turnbolt, each turnbolt having a head and a shank, the locking device comprising:

a hollow tubular member which is sealed at one end and normally open at the other end, a slot extended from the open end being formed in a side of said member, the length of said slot being greater than the spacing between the two most widely separated of said turnbolt shanks, the hollow portion of said member being large enough to permit the turnbolt heads to be fitted therein when said slot is fitted, open end first, over said shanks;

a cylinder lock having an opening formed therethrough, said lock being adapted to seal the open end of said member when said member is positioned on said turnbolts; and inhibit means passing through said opening in the lock and aligned openings in said member when said member is mounted on said turnbolts and is sealed by said locking means, the inhibit means being engaged by the lock and held in place thereby to prevent removal of the lock from the member.

15. A locking device as claimed in claim 14 wherein said lock is a pop up type cylinder lock.

16. A locking device as claimed in claim 15 wherein said cylinder lock is wholly within said tube when said openings are aligned.

17. A locking device as claimed in claim 16 including means for plugging the open end of said member when said lock is positioned therein to waterproof said tube.

* * * * *
* * * * *